US007572196B2

(12) United States Patent
Kotze et al.

(10) Patent No.: US 7,572,196 B2
(45) Date of Patent: Aug. 11, 2009

(54) DAMPENING DEVICE FOR A RACKET

(75) Inventors: Johan Kotze, Bregenz (AT); Stefan Mohr, Wolfurt (AT); Jürgen Wilke, Wolfurt (AT)

(73) Assignee: Head Technology GmbH, Kennelbach (AT)

( * ) Notice: Subject to any disclaimer, the term of this patent is extended or adjusted under 35 U.S.C. 154(b) by 184 days.

(21) Appl. No.: 11/701,374

(22) Filed: Feb. 2, 2007

(65) Prior Publication Data

US 2007/0293357 A1 Dec. 20, 2007

(30) Foreign Application Priority Data

Feb. 2, 2006 (DE) ..... 10 2006 004 850

(51) Int. Cl.
*A63B 51/00* (2006.01)

(52) U.S. Cl. ..... 473/522; 473/553

(58) Field of Classification Search ..... 473/520–522, 473/539, 540, 546
See application file for complete search history.

(56) References Cited

U.S. PATENT DOCUMENTS

| | | | | |
|---|---|---|---|---|
| 4,180,265 | A | 12/1979 | Staufer | |
| 4,190,249 | A | 2/1980 | Fischer | |
| 4,589,662 | A * | 5/1986 | Robaldo | 473/522 |
| 4,732,383 | A | 3/1988 | Ferrari et al. | |
| 4,765,620 | A * | 8/1988 | Janes | 473/521 |
| 4,776,590 | A | 10/1988 | Krent et al. | |
| 5,350,173 | A * | 9/1994 | DiCerbo | 473/521 |
| 5,871,409 | A * | 2/1999 | Kimoto | 473/522 |
| 6,506,133 | B1 * | 1/2003 | Hong | 473/539 |
| 6,561,933 | B1 * | 5/2003 | Hsu | 473/521 |
| 6,755,756 | B2 * | 6/2004 | Sung | 473/522 |
| 2007/0293357 | A1 * | 12/2007 | Kotze et al. | 473/522 |

FOREIGN PATENT DOCUMENTS

| | | |
|---|---|---|
| AT | 352 590 | 9/1979 |
| DE | 78 04 223 | 2/1979 |
| DE | 84 05 102 | 2/1984 |
| DE | 35 04 137 A1 | 8/1986 |
| DE | 37 24 205 A1 | 1/1989 |

(Continued)

OTHER PUBLICATIONS

English-language translation of the description section of German Patent Application No. DE 84 05 102 published on Feb. 20, 1984.

*Primary Examiner*—Raleigh W. Chiu
(74) *Attorney, Agent, or Firm*—Finnegan, Henderson, Farabow, Garrett & Dunner, LLP

(57) ABSTRACT

The present invention relates to a dampening device for ball game rackets. The dampening device of the present invention includes at least one dampening element having a foot or base region, a head region and a neck or connection region arranged between the foot region and the head region. The provision of a neck or connection region leads to an optimum distance between foot or base region and head region and/or an optimum and safe positioning of the head region in the stringing plane at a preferred distance from the heart region of the racket. Preferably, the neck region is tapered or necked relative to the foot or base region and/or the head region at least in the width or thickness direction of the dampening device of the invention.

20 Claims, 6 Drawing Sheets

FOREIGN PATENT DOCUMENTS

| | | | |
|---|---|---|---|
| DE | 39 10 890 | A1 | 10/1989 |
| DE | 690 25 588 | T3 | 9/2001 |
| DE | 10 2004 025 346 | A1 | 12/2005 |
| EP | 0 261 994 | A2 | 3/1988 |
| EP | 0 441 971 | A1 | 8/1991 |
| EP | 0 497 561 | A1 | 8/1992 |
| EP | 0 642 811 | A1 | 3/1995 |
| GB | 2 191 409 | A | 12/1987 |
| JP | 3-231689 | | 10/1991 |
| WO | WO 88/02271 | | 4/1988 |
| WO | WO 90/09215 | | 8/1990 |

* cited by examiner

DAMPENING DEVICE FOR A RACKET

BACKGROUND OF THE INVENTION

1. Field of the Invention

The present invention relates to a dampening device for ball game rackets, in particular tennis, squash, racquetball, badminton or paddle tennis rackets, which can be fixed in particular to a stringing and/or a frame of the ball game racket. Moreover, the present invention relates to a ball game racket comprising a dampening device of this kind. A method for manufacturing a racket of this kind and a method for fixing a device of this kind to a ball game racket are described as well.

Ball game rackets of the above-mentioned type comprise a frame having a head region for retaining a stringing and a handle or grip portion. Rackets of this kind can also comprise a heart or throat region or fork being arranged between the head region and the grip portion.

When striking a ball with the racket, the racket, in particular the stringing and the frame, is first deflected by the ball. After the ball has deflected the racket, the ball flies away from the bent or deflected racket. After separation from the ball, the racket begins to vibrate in its free dampened vibration (natural or characteristic frequency). In particular the vibrations generated when the ball hits the strings of the racket are transmitted to the arm of the user. Such forces or shocks or vibrations caused by striking a ball are, at least when acting for a long time, i.a. responsible for health problems of the player, such as for instance the so-called tennis elbow. Furthermore, a continuous compensation of the impact shock and the forces occurring during the game make the player quickly tired. Moreover, the control of the racket and thus the playability behavior are influenced by too strong forces and vibrations acting on the player. Moreover, the vibrations of the string that was excited by the strike are often sensed as being disturbing. This is because the frequency of the vibrations of the excited strings lies at least partially in the audible range.

2. Description of Related Art

Dampening devices for ball game rackets are generally known. DE-U-84 051 02 describes a means for dampening the vibration in the stringing of ball striking devices, which consists of crossing longitudinal and transverse strings and comprises a coupling member that acts as a vibration dampening element and couples at least two longitudinal strings in at least one of their end regions mechanically. To this end, the coupling member is configured as an elastic element comprising a retainer for the longitudinal strings by means of which the longitudinal strings are spaced from each other at a distance which preferably differs from the distance between the longitudinal strings to be coupled. The retainer for the longitudinal strings to be coupled comprises retainer sleeves that can be pushed over these strings, and the coupling member comprises at least one further retainer in the form of a hole for a transverse string.

U.S. Pat. No. 4,732,383 describes a shock and vibration absorber for rackets, which is configured as a bar and weaved over and under the longitudinal strings in a region between the grip and the nearest transverse string. This absorber extends across the entire width of the racket in this region, wherein the ends are fixed in the spaces between the frame and the nearest longitudinal strings. The bar-shaped absorber is composed of a plurality of layers of a shock-and-frequency absorbing material which is soft, light and resilient.

EP-A-0 497 561 relates to a vibration damper for ball game rackets, which is configured as a flexible, rubber-like strap having dampening characteristics, wherein the flexible strap comprises a body portion with opposing sides and with a plurality of transversely extending ribs formed thereon in spaced apart longitudinal relation as well as end portions which are integrally connected with the body portion of the flexible strap, wherein the flexible strap is fixed by means of fixing means to adjacent longitudinally extending sides of the racket head and interwoven with the strings.

DE-A-35 041 37 discloses a ball game racket in which at least one dampening means can be fixed to the stringing in a frame for dampening the vibrations after striking the ball, wherein the respective dampening means is inserted into free fields formed by strings of a stringing and is held in a form-fit manner by the strings of the stringing.

U.S. Pat. No. 4,776,590 discloses a dampening means for ball game rackets, which is formed by a block of viscoelastic foam and inserted between the strings of the racket stringing, wherein the compressed block typically engages four neighboring strings.

AT-B-352 590 describes a means for absorbing vibrations in ball game rackets, wherein at least two longitudinal strings of the stringing are mechanically coupled preferably at the heart-side end thereof by means of a vibration absorber, the vibration absorber being arranged outside the region of the transverse strings.

GB-2 191 409 relates to a ball game racket comprising a dampening means having a plurality of holes through which the longitudinal strings of the racket stringing are led, wherein the dampening means is arranged in the stringing region below the transverse strings so as to adjoin the racket frame and fixed by means of a fixing means led from outside through the holes of the racket frame that serve for retaining the stringing.

Further, different kinds of dampening means are disclosed, e.g., in JP-A-03231689, EP-A-0 642 811, EP-A-0 261 994, U.S. Pat. No. 4,190,249, DE-A-37 24 205, DE-A-39 10 890, WO-A-8802271, DE 10 2004 025 346 A1, EP-A-0 441 971 and WO-A-9009215.

These known dampening devices are not satisfying in view of their dampening characteristics, in particular with respect to the vibrations transmitted to the player and the acoustic effects of the vibrations, their fixing requirements, their relatively involved and thus expensive production and/or their high weight. Furthermore, they do not or only insufficiently influence the vibrations of the frame or the transmission of the string vibrations to the frame.

SUMMARY OF THE INVENTION

It is the object of the present invention to provide an improved dampening device and an improved ball game racket. Additional or alternative objects of the invention are to provide a dampening means and/or a ball game racket which overcome the disadvantages of the prior art, improve the vibration behavior, improve the striking sound, can be manufactured in a simple and cost-efficient manner, can be fixed in a simple and cost-efficient manner, guarantee improved handling characteristics of the racket with and without strings and/or have or cause improved playing characteristics.

This object is achieved by the features of the independent claims. The dependent claims relate to preferred embodiments of the present invention.

The invention starts out from the basic idea to provide a dampening device comprising at least one dampening element, the dampening element comprising a foot or base region, a head region and a neck or connection region located between the foot and head regions. The provision of a neck or connection region leads to an optimum distance between the foot or base region and the head region and/or to an optimum and safe positioning of the head region in the stringing plane at a preferred distance from the heart region of the racket. At least in the width or thickness direction of the dampening device of the invention, the neck region is preferably tapered or necked relative to the foot or base region and/or the head region. The dampening device is preferably fixed by means of a fixing element in the region of the racket heart to the frame of the ball game racket and is then located in the region of the string bed.

The foot or base region serves, i.a., for fixing the dampening device to the racket heart and, therefore, in the following it is also called fixing region. The foot or fixing region is essentially arch-shaped or U-shaped, wherein the neck portion is connected to the foot region in the region of the arch cupola or in the region of the base leg of the U-shape, and wherein the open side of the U-shape or arch faces away from the neck or head region of the dampening element. The neck region of the dampening element is preferably configured as a web and preferably arranged centrically with respect to the foot region and/or head region. On the whole, the dampening element preferably has an essentially oval and/or rectangular or cuboidal base shape or envelope. The dampening element has preferably the shape of an elongate, flat and possibly oval cuboid. As already stated, the thickness and/or width of the neck region is reduced, particularly preferably reduced essentially, as compared to the thickness and/or width of the base shape.

The fixing region of the dampening element of the present invention comprises preferably at least two legs being arranged essentially parallel with respect to one another, wherein the legs of the fixing region are preferably configured so as to be coupled each to a longitudinal string of a racket stringing. To this end, the fixing region preferably comprises at least one groove, recess, opening, channel and/or hole (in the following the generic term opening is used) for being coupled with or for retaining a longitudinal string. The fixing region preferably comprises two legs each having an opening for retaining and being coupled with a longitudinal string.

The opening is preferably realized as a bore having a constant diameter. According to a preferred embodiment—as described later—the opening is realized as a bore having different cross-sectional regions.

The opening is preferably configured such that it firmly encloses a longitudinal string at least partially and at least in a partial region of the opening, preferably by an interference fit. The preferably at least two openings of the fixing region are preferably configured and arranged such that their respective longitudinal center lines at least essentially align with the longitudinal center line of the corresponding longitudinal string to be retained or coupled. Thus, the dampening element can be arranged in the stringing of a ball game racket without changing the distance or tension of the strings or longitudinal strings as compared to their starting position, i.e. the state without dampening element.

The neck region of the dampening element is preferably configured like a web and connects the fixing region and the head region. At the same time, the neck region of the dampening element causes a defined distance between the head region and the fixing region and preferably also allows the head region to be positioned at a defined distance from the racket frame, preferably from the racket heart and in the region of the racket stringing or on the string bed.

The head region of the dampening element preferably comprises means for being coupled with preferably at least two, more preferably two to eight, and most preferably three strings of the racket stringing. The means are preferably configured as cavities, recesses, slots, grooves, holes and/or bores. The head region preferably comprises means for being coupled with at least two longitudinal strings and at least one transverse string of a racket stringing. The means of the head region that are intended for retaining or being coupled with the longitudinal strings are preferably flush with the corresponding means of the fixing region so that they preferably retain or are coupled with the same strings. The head region of the dampening element is preferably realized as a dampening mass which is connected via the neck region with the fixing region which can preferably be coupled with the racket frame. The head region of the dampening device preferably has a greater, particularly preferably an essentially greater mass than the neck region. At least in one plane, e.g. the stringing plane, the head region is preferably approximately circular. According to a preferred embodiment, the head region comprises an additional dampening mass. Such an additional dampening mass can be formed, e.g., by arranging a material having a high density in or on the head region. The head region preferably comprises one or more additional dampening masses in the form of, in particular, metal particles, preferably metal beads.

In a preferred embodiment, the dampening device can be connected with at least one fixing element, wherein the dampening device is arranged in the stringing region of the ball game racket and wherein the fixing element can be arranged in the frame region of the ball game racket and wherein moreover the dampening device and the at least one fixing element can be connected releasably. The fixing element is particularly preferably configured such that it supports or supplements the dampening effect of the dampening device.

The dampening device and the at least one fixing element can be preferably connected by the racket frame, wherein in accordance with a preferred embodiment at least the dampening device or the at least one fixing element at least partially penetrate the racket frame. The at least one fixing element preferably encloses at least two strings of the ball game racket stringing completely. The strings are preferably led through the respective fixing element. In a preferred embodiment, the strings extend through the dampening device and the fixing element and are enclosed by them completely.

According to a preferred embodiment, the dampening device and/or the fixing element are preferably formed as one piece, i.e. integrally.

In accordance with a preferred embodiment, the dampening device and the fixing element can be connected in a shrink fit or interference fit manner. To this end, the dampening device encloses the fixing element preferably at least partially.

In a preferred embodiment, the fixing element penetrates the racket frame from its outer surface and can be connected with the dampening device in the stringing region. The fixing element preferably penetrates the racket frame at openings that are provided in the racket profile for retaining the strings or for leading the strings therethrough. To this end, the fixing element is configured similar to a head, eye or heart strap to be arranged at the racket head and comprises a strap portion and at least one sleeve portion attached thereto, wherein the strap portion and the at least one sleeve portion are preferably formed integrally, i.e. as one piece. The number of sleeve-shaped portions preferably corresponds to at least the number of strings to be retained. To this end, the sleeve-like portions have preferably such a length that they penetrate the racket frame to such an extent that they extend into the stringing region of the racket where they can be connected with the dampening device.

The means for leading through strings or for being coupled with strings, which are provided in the fixing region of the dampening device, are preferably at least partially configured such that they can be connected or coupled with the sleeve-like portions of the fixing element extending into the stringing region of the racket.

In a further preferred embodiment, the openings provided preferably in the legs of the fixing region have at least one portion whose diameter is such that a string led through the opening is enclosed in this region tightly and preferably without clearance.

In a preferred embodiment, the dampening device and/or the fixing element comprise preferably an elastomer, thermoplastic elastomer (TPE), thermoplastic polyurethane (TPU), thermoplastic polyolefin (TPO) and/or silicone or are made thereof.

In a further preferred embodiment, the dampening device has a hardness of preferably 5 to 100 Shore A, preferably approximately 20 to 70 Shore A, and particularly preferably approximately 40 Shore A.

In a further preferred embodiment, the fixing element is harder than the dampening device. In a further preferred embodiment, the dampening device has a density of approximately 0.30 to 2 g/cm$^3$, preferably approximately 0.90 to 1.40 g/cm$^3$, and particularly preferably approximately 0.95 to 1.20 g/cm$^3$. The dampening device preferably comprises an additional dampening mass being preferably arranged in the head region and having a density of preferably approximately 2 to 10 g/cm$^3$.

The weight of the dampening device preferably lies in the range of approximately 1 g to 10 g and preferably at approximately 3 g. The weight of the fixing element preferably lies in the range of approximately 0.5 to 5 g and particularly preferably in the range of approximately 2 g.

In a preferred embodiment, the dampening device is arranged in the region of the racket frame head that faces the heart region or grip region. The dampening device is preferably arranged in the region of the longitudinal strings, i.e. below the first transverse string of the stringing. Preferably, the dampening device can be coupled with a transverse string, preferably with the lowermost transverse string. The dampening device of the present invention is particularly preferably coupled with at least the longest longitudinal string(s) of the stringing.

The present invention furthermore relates to a ball game racket comprising a dampening device according to the present invention.

According to a process for manufacturing an improved ball game racket comprising a dampening device according to the present invention, a ball game racket is first produced in accordance with the manufacturing process known in the art.

In such a racket, the fixing element is preferably arranged in the region of the bridge or the connection portion, as described above, such that the sleeve-like portions are led from the outside through the openings of the racket frame so that they extend beyond the inner side of the frame. The strap portion of the fixing element preferably adjoins the outer side of the frame, and the sleeve portions project inwardly. Then, the dampening device is preferably pushed or placed from the inner side of the frame onto the sleeve portions of the fixing element that project from the frame. By the correspondingly selected outer diameters of the sleeve portions as well as the at least partially correspondingly configured inner diameters of the recesses or openings of the dampening device, the dampening device and the fixing element are connected with each other in a shrink fit or interference fit manner. In an alternative method, the dampening device is first positioned at the inner side of the racket frame and then the fixing element is led through the racket frame and into the dampening device. The dampening device and the fixing element are now connected with each other and with the racket frame. Subsequently, the strings are attached to the racket in the normal manner, wherein first some longitudinal strings are led through the sleeves of the fixing element.

The dampening device of the present invention is in particular advantageous in that the dampening characteristics of the head can be used in an optimum manner thanks to the structure of fixing region—neck region—head region. In particular, an exact, safe and reproducible positioning of the dampening device and particularly of the head of the dampening device can be guaranteed. Furthermore, since a neck region is realized in accordance with the invention, the head region is decoupled to a large extent from the foot region or is coupled therewith in a defined manner, so that an optimum dampening behavior of the dampening device in view of the stringing and the frame as well as a well-aimed coupling of the vibrations of frame and strings are achieved. In particular, shifting of the head region, which is preferably the main dampener, towards the racket heart is avoided, which would lead to a reduction in the dampening function. Due to the configuration of the neck region, there is at the same time a defined relation between dampener head, dampener foot and racket frame.

The configuration of the dampening device comprising a fixing element according to the invention also allows a purposeful coupling to the frame. The foot region further allows a safe positioning of the dampening device with respect to the racket frame as well as a safe fixing thereto. Shifting of the dampening device and in particular of the head region is therefore reliably avoided during the match and during transport.

Furthermore, the dampening device according to the invention allows a safe and accurate fixing also to rackets frames without strings. Since the racket is normally manufactured and distributed to retailers without strings, the configuration of the neck region according to the invention allows a structural stiffness of the dampening device which—even in case rather soft materials are used—prevents to a large extent that the dampening device bends out of the stringing plane during transport and thus allows an easy handling and an easy transport of the racket without strings.

BRIEF DESCRIPTION OF THE DRAWINGS

In the following, the dampening device according to the invention is described on the basis of a preferred embodiment and with reference to the drawings in which

FIG. 3 shows curves of the vibration amplitude of the racket frame or stringing depending on the distance of the head region of a dampening device according to the invention from the heart region of a racket, wherein

DETAILED DESCRIPTION

Figure 1:
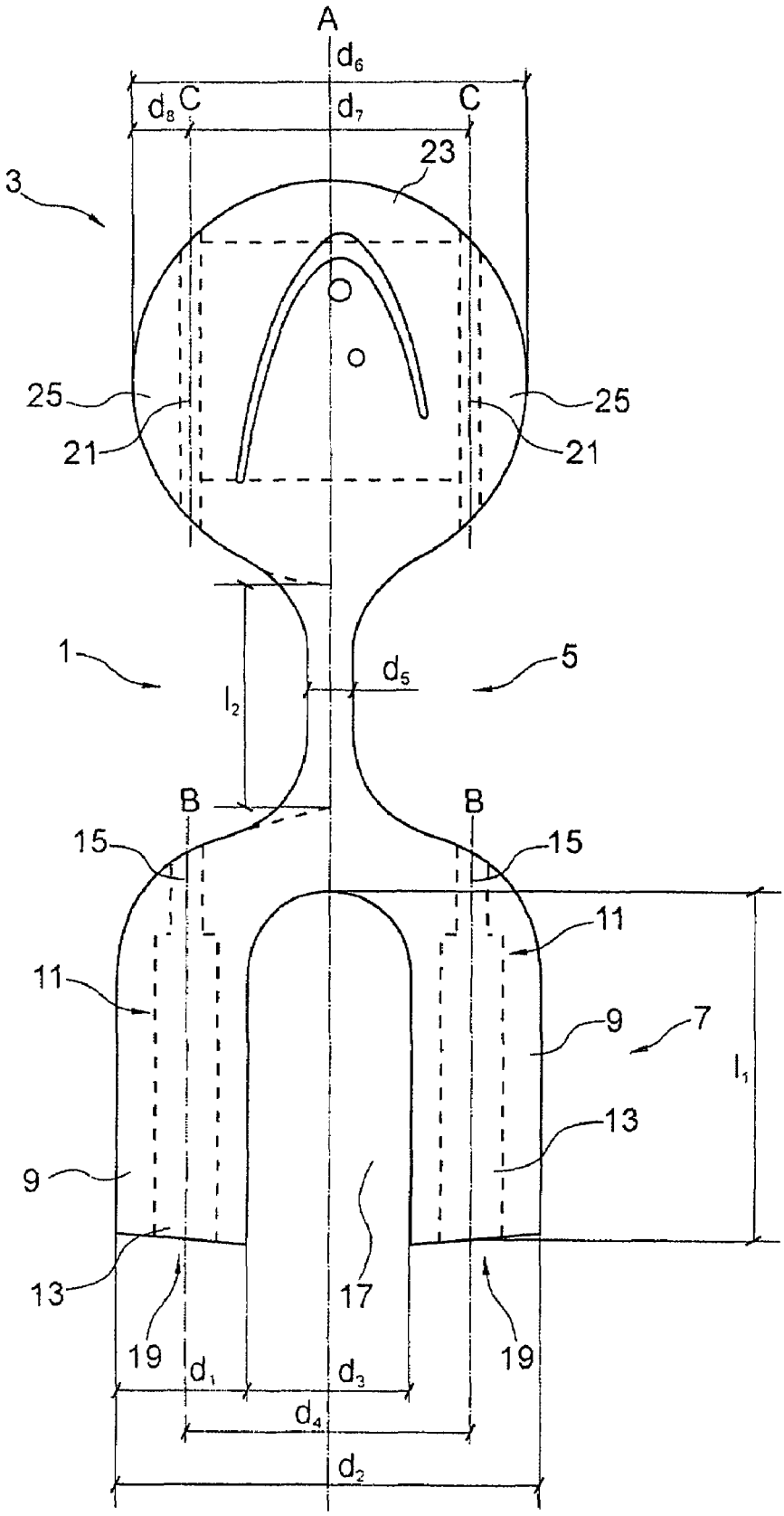
FIG. 1 is a top view of a dampening device according to the invention.

FIG. 1 shows a top view of a dampening element or dampening device 1 according to the invention. The dampening element 1 according to the invention comprises a head region 3, a foot or fixing region 7, as well as a neck region 5 arranged between the foot region 7 and the head region 3. The foot or fixing region 7 is preferably U-shaped or arch-shaped and preferably comprises two legs 9 extending in the longitudinal direction of the dampening element 1. The neck region 5 is preferably realized as a web and has a width that is smaller as compared to that of the legs 9, as shown in the top view of FIG. 1. Preferably approximately at the cupola of the U-shaped or arch-shaped fixing region 7, the neck region 5 merges into the fixing region 7. The head region 3 of the dampening element 1 is arranged at the end of the neck or connection region 5 opposite the fixing region 7. In accordance with a preferred embodiment of the invention, the head region 3 is essentially circular in the top view. According to further embodiments of the invention, the head region 3 has a geometry that differs in the top view of FIG. 1 from a clear circular shape, such as an elliptical, square, rectangular or polygonal shape.

As shown in FIG. 1, the neck region 5 is preferably arranged centrically as regards the foot region 7 and/or the head region 3. At least in the width and/or thickness direction of the dampening device 1 of the present invention, the neck region 5 is preferably tapered or necked relative to the foot or base region 7 and/or the head region 3 and has a reduced, particularly preferably essentially reduced thickness and/or width. In this case, the width is the width of the web-like neck region 5 in the representation of FIG. 1. Thickness refers to the dimension perpendicular with respect to the sheet plane of FIG. 1.

The fixing region 7 comprises preferably at least two openings 11 which extend essentially along or parallel to the longitudinal axis A of the dampening element and are arranged essentially parallel with respect to one another. Preferably, each leg 9 of the fixing region 7 comprises one opening 11. In accordance with a preferred embodiment, the openings 11 comprise two portions 13, 15 having different dimensions. Longitudinal strings of the stringing (not shown) can be led through the openings 11. The portion 15 of the openings 11 preferably has an essentially round diameter which is adjusted to the diameter of the strings so that the opening region 15 encloses one string tightly and essentially without clearance or only slight clearance. The diameter of the region 15 can be selected such that it is smaller than the corresponding string diameter so that the region 15 has to be expanded for retaining the string and encloses the string in a shrink fit or interference fit or transition fit manner.

The diameter in the region 15 typically lies between approximately 0.7 mm and approximately 1.5 mm, preferably between approximately 1.1 mm and approximately 1.4 mm. In a preferred embodiment, the diameter in the region 15 is approximately 1.3 mm. The diameter of a suitable string of a stringing of a ball game racket can range between approximately 0.8 mm and approximately 1.7 mm, preferably between approximately 1.1 mm and 1.5 mm, and particularly preferably between approximately 1.2 mm and approximately 1.4 mm, wherein the diameter of the strings can also vary slightly.

Furthermore, the openings 11 preferably have a portion 13 having a diameter that is larger than that of the portion 15. The diameter of the portion 13 can be selected such that it can retain a corresponding sleeve-shaped portion of a fixing element (cf. FIG. 2). Preferably, the sleeve-shaped portion of the fixing element is connected with portion 13 of the opening 11 of the first dampening element 1 also in an interference fit or shrink fit manner, wherein the outer diameter of the sleeve-shaped portion of the fixing element is somewhat larger than the inner diameter of the corresponding portion 13. For instance, the inner diameter of portion 13 lies in the range of approximately 2.5 mm to approximately 5 mm, preferably approximately 3.5 to approximately 4.2 mm, and particularly preferably at approximately 3.7 mm.

Preferably, the inner diameter of the opening 11, the region 15 and/or the region 13 is essentially circular. However, the opening 11 can also have different geometries, at least in parts, if a string leading through it is enclosed at least partially tightly and essentially without clearance or with a slight clearance.

The openings 11 of the first dampening element 11 can have an opening length in the range of approximately 3 mm to 30 mm and preferably in the range of approximately 5 mm to approximately 25 mm. The length of the portions 13 preferably lies in the range of approximately 1 mm to 20 mm, more preferably in the range of approximately 2 mm to approximately 15 mm, and particularly preferably in the range of between approximately 10 mm and approximately 14 mm. Furthermore, the portions 15 of the openings 11 preferably have a length in the range of approximately 0.5 mm to approximately 10 mm, more preferably in the range of approximately 1 mm to approximately 8 mm, and particularly preferably in the range of between approximately 2 mm and approximately 5 mm. The respective openings 11 and their respective portions 13 and/or 15 can have different diameters. In a preferred embodiment, the openings 11 and their respective portions 13, 15 have essentially the same length.

In a further embodiment of the dampening element, the openings 11 have a plurality of chamfers and/or diameter transitions in the region of the transition of portions 13 and 15. In a preferred embodiment, the diameter of an opening 11 in the region of the transition of portion 13 and portion 15 is reduced continuously and/or stepwise starting from the diameter of the portion 13 towards the diameter of the portion 15. At their ends, the openings 11 can have chamfers or radiuses. Such chamfers or radiuses lead in particular to an easy introduction of the strings or sleeve-shaped portions into the openings 11, an improved vibration or dampening behavior and/or an improved stress distribution in the dampening device for avoiding stress peaks which can damage the dampening device.

The dampening device 11 is preferably mirror-symmetrical with respect to a longitudinal axis A. Moreover, the foot region 7, the neck region 5 and/or the head region 3 are preferably configured as one piece, i.e. integrally.

The legs 9 of the fixing region 7 preferably have a width $d_1$ (in the drawing plane of FIG. 1) and/or a thickness (perpendicular with respect to the drawing plane of FIG. 1, not shown) of approximately 4 mm to approximately 8 mm, preferably approximately 6 mm. The length of a leg preferably corresponds essentially to the length of a hole 11. The cross-section of a leg 9 preferably has a square, rectangular or circular contour. In case of a square cross-section, in preferred embodiments one or more sides have a radius. Such a radius is preferably 2 to 3 mm. Preferably, the sides of the legs 9 facing outwardly, i.e. away from the dampening element, have a radius, while the remaining sides are essentially flat. The outer sides of the legs are preferably spaced by a distance $d_2$ of approximately 17 mm to approximately 23 mm and preferably approximately 20 mm. The inner sides of the legs 9 are preferably spaced by a distance $d_3$ of approximately 5 mm to approximately 9 mm, preferably approximately 7 mm. The longitudinal axes B of the holes 11, which extend essentially parallel with respect to the longitudinal axis A of the dampening element 1, are preferably spaced by a distance $d_4$ of preferably approximately 11 mm to approximately 15 mm, particularly preferably approximately 13 mm.

The length $l_1$ of the recess 17 formed between the legs 9 of the fixing element 7 preferably lies in the range of approximately 3 mm to approximately 20 mm, more preferably in the range of approximately 8 mm to approximately 17 mm, and particularly preferably in the range of approximately 15 mm. In the top view according to FIG. 1, the lower sides 19 of the legs 9 are preferably flat. They preferably imitate the corresponding frame contour which they adjoin. Hence, the lower surface of the dampening element of the invention according to FIG. 1 has preferably a geometry which corresponds to the inclination or radius of the inner contour of a corresponding area of a racket frame.

In the top view of FIG. 1, the outer sides of the legs 9 of the fixing element 7 preferably pass into the neck region 5 in a bent manner or having a radius.

The neck region 5 of the dampening element 1 is preferably formed as a web and preferably has an essentially rectangular, circular or oval cross-section which, on the one hand, passes without any transition into the head region 3 of the dampening element 1 and, on the other hand, without transition into the fixing region 7 of the dampening element 1. The neck region 5 of the dampening element 1 has preferably a length $l_2$ of approximately 5 mm to approximately 15 mm, more preferably of approximately 7 mm to approximately 13 mm, and particularly preferably of approximately 11 mm. The length $l_2$ of the neck region 5 is measured on the basis of the two closest points of an imaginarily continued outer contour of the head region 3 as well as the fixing region 7 along the longitudinal axis A of the dampening device 1.

The width $d_5$ of the neck region 5 at its narrowest point, preferably approximately in the center with respect to its length $l_2$, is preferably approximately 1 mm to approximately 10 mm, particularly preferably approximately 1.5 mm to approximately 3 mm and particularly preferably approximately 2 mm. The thickness at a corresponding point, i.e. the extension of the neck region 5 perpendicularly with respect to the sheet plane according to the representation of FIG. 1, preferably lies in the range of 1 mm to approximately 6 mm, particularly preferably in the range of approximately 1.5 mm to approximately 5 mm, and particularly preferably in the range of approximately 3 mm. Preferably, the thickness of the neck region is larger, e.g., at least 0.5 mm larger than its width so that, perpendicularly with respect to the stringing plane, the dampening element is more resistant to bending and is thus less deflected, e.g., during transport.

The reduction in the cross-section of the neck region 5 relative to the foot region 7 and/or the head region 3 in the thickness and/or width direction preferably lies in the range between approximately 10% and 95%, more preferably between approximately 25% and 90%, even more preferably between approximately 45% and 85% and particularly preferably above 50% or above 75%.

In the sheet plane according to the representation of FIG. 1, the head region 5 has preferably a circular shape having a diameter $d_6$ of preferably approximately 15 mm to approximately 25 mm, particularly preferably approximately 16 mm to approximately 22 mm, and particularly preferably approximately 18 mm. The thickness of the head region 3 measured perpendicularly with respect to the sheet plane according to the representation of FIG. 1 is preferably uniform and preferably approximately 2 mm to approximately 10 mm, particularly preferably approximately 4 mm to approximately 8 mm, and particularly preferably approximately 6 mm.

The head region 3 comprises means 21, 23 for coupling the dampening element 1 in the head region 3 with the strings of a stringing. The head region 3 preferably comprises two means 21 for being coupled with a respective longitudinal string of the stringing and a means 23 for being coupled with a transverse string of the stringing. The means 21, 23 are preferably formed by slots, grooves, cavities, brackets and/or bores which form corresponding openings 21, 23. Preferably, the openings 21, 23 do not form a closed profile but are open towards their outer sides, i.e. in accordance with the representation in FIG. 1 to the right-hand side or the left-hand side (opening 21) or the top (opening 23) in order to allow a string to be retained therein. In contrast thereto, the openings 11 in the fixing region 7 have preferably a closed profile.

According to a preferred embodiment of the invention, the openings 21 are approximately circular, wherein across their entire lateral outer lengths they pass into a slot 25. The slot 25 has preferably a smaller thickness (perpendicular with respect to the drawing plane according to FIG. 1) than the diameter of the openings 21 and extends across the entire length of the openings 21 up to the outer side of the head region 3.

The diameter of the openings 21 has typically the same size as that of the openings in the region 15.

The openings 21 or the center line C of the openings 21 are/is preferably flush with the center line B of the openings 11 of the fixing region 7. Thus, the openings 21 and the openings 11 preferably serve for being coupled to the same strings.

The openings 21 are preferably spaced from each other by a distance $d_7$ in the range of preferably approximately 11 mm to approximately 15 mm and particularly preferably approximately 13 mm and, furthermore, preferably have a maximum distance $d_8$ of approximately 1 mm to approximately 4 mm and particularly preferably approximately 2.5 mm from the outer side of the head region 3. The distances are measured from the center line C of the openings 21. The distance $d_7$ preferably corresponds to the distance $d_4$.

The opening 23 is preferably realized as a slot, wherein in the region of the longitudinal axis A of the dampening device 1, the slot has preferably a maximum depth of approximately 2 mm to approximately 4 mm, particularly preferably approximately 3 mm. Preferably, the slot-shaped opening 23 has a width of approximately 7 mm. The slot 23 has preferably a smaller width (perpendicular with respect to the drawing plane of FIG. 1) than the diameter of the openings 21 and extends across the entire width of the head region 3 up to the outer side of the head region 3. The opening 23 preferably passes into the openings 21 and/or slots 25. Preferably, the thickness (perpendicular with respect to the drawing plane according to FIG. 1) of the opening 23 lies in the range of approximately 0.5 mm to approximately 1.5 mm and particularly preferably approximately 1 mm. The slots 23 and 25 preferably have the same thickness.

Particularly preferably, the dampening device has an overall length in the range of preferably approximately 35 mm to approximately 60 mm, more preferably approximately 40 mm to approximately 52 mm and particularly preferably approximately 47 mm.

Figure 2:
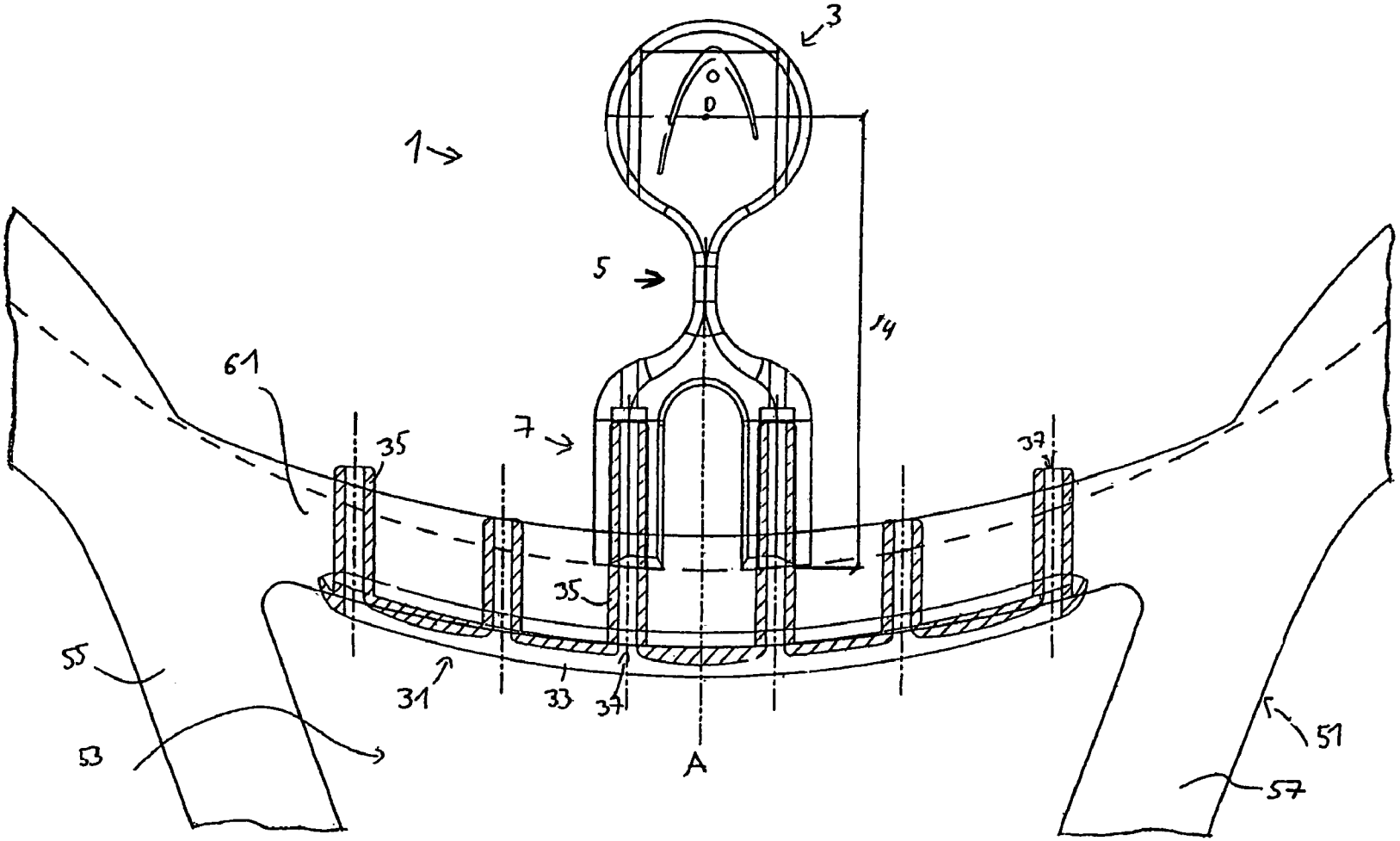
FIG. 2 is a top view of a dampening device according to the invention, which is attached to a racket by means of a fixing element.

The distance $l_4$ of the center D of the head region 3 of the dampening device 1 or that of the center of gravity D of the head region 3 to the lower side of the dampening device 1 adjoining the racket frame or to the racket frame is shown in FIG. 2. The length $l_4$ preferably lies in the range of approximately 1.5 cm and 7 cm, particularly preferably in the range between approximately 2 cm and approximately 4.5 cm and even more preferably between approximately 3 cm and approximately 4 cm. Preferably, the center of gravity D lies below the first transverse string.

FIG. 2 shows a dampening device 1 of the present invention, which is fixed by means of a fixing element 31 according to the present invention to the bridge 61 of a ball game racket frame (only shown partially). The fixing element 31 comprises a strap-shaped portion or a strap 33 and at least one sleeve portion or a sleeve 35 arranged thereto. The strap 33 and the sleeve 35 are preferably formed as one piece, i.e. integrally. At least one opening 37 for retaining at least one string of the stringing of the ball game racket extends through the strap 33 and the sleeve 35. Although the strap 33 is essentially flat in the shown embodiment, it can have any other cross-sectional shape that is common, e.g., for head, neck and sleeve straps. Preferably, the strap 33 is configured such that its contour facing the sleeves 35 corresponds to the contour of a ball game racket frame at a respective point. Preferably, the sleeves 35 have at least partially a length that is sufficient for penetrating the frame profile of the racket from the outside and projecting in such a manner from the inner side of the racket that a suitable connection with the dampening element 1 is possible. The sleeves 35 have preferably a length of approximately 8 mm to 30 mm and particularly preferably of approximately 12 mm to approximately 25 mm. Preferably, the sleeves 35 have at least partially different lengths. The centrally arranged sleeves 35 preferably have the same length. Preferably, the fixing element 31 is mirror-symmetrical with respect to the axis A. The sleeves 35 are preferably spaced in accordance with the arrangement of the openings in the racket frame. The fixing element preferably comprises two sleeves 35, but it can also comprise a plurality of sleeves 35, e.g. six.

FIG. 2 schematically shows a detail of the heart region of a ball game racket of the present invention comprising an opening 53 that is formed by two side portions 55, 57 and a connection portion or a bridge 61 in the head region of the racket. For example, for the purpose of strength, a further connection can be provided between the two side portions 55, 57 of the heart region.

According to the preferred embodiment shown in FIG. 2, the dampening element 1 is arranged at the inner side of the bridge 61, i.e. in the region retaining the stringing. The fixing element 31 is arranged at the corresponding opposite outer side of the bridge 61 in such a manner that the strap 33 adjoins the bridge 61. Furthermore, the sleeves 35 of the fixing element 31 are led through the openings for retaining the strings that are provided in the frame. The dampening element 1 is arranged at the inner side of the bridge 61 in such a manner that it encloses or retains the projecting sleeves 35 by its openings 11. The diameters are preferably selected such that the dampening element 1 and the fixing element 31 are connected in a shrink fit or interference fit manner. To this end, the outer diameter of the sleeves 35 is preferably larger than the inner diameter of the openings 11 or portions 13 so that the openings 11 are widened when connecting the dampening elements. To this end, the ends of the openings 11 and/or the sleeves 35 preferably have radiuses or chamfers.

As shown in FIG. 2, the dampening device can be arranged at the ball game racket 51 in such a manner that the dampening element 1 is arranged in the region of the stringing below the lowermost transverse string in the region of the longest longitudinal string. The strings preferably form a shrink fit or interference fit with the portions 15 and the openings 37. The dampening element 1 and/or the fixing element 31 is/are therefore preferably made of an elastically deformable material. The dampening element 1 and/or the fixing element 31 preferably comprise(s) or is/are made of an elastomer, thermoplastic elastomer (TPE), thermoplastic polyurethane (TPU), thermoplastic polyolefin (TPO) and/or silicone. In a further preferred embodiment of the invention, the fixing element 31 is made of materials that are known for the use as head, heart or eye straps, such as polyamide (e.g. PA-66, PA-11) or acryl nitrile butadiene styrene (ABS).

The weight of the fixing element 31 preferably lies in the range of approximately 0.5 to 6 g and more preferably in the range of approximately 2 g.

Figure 3A:
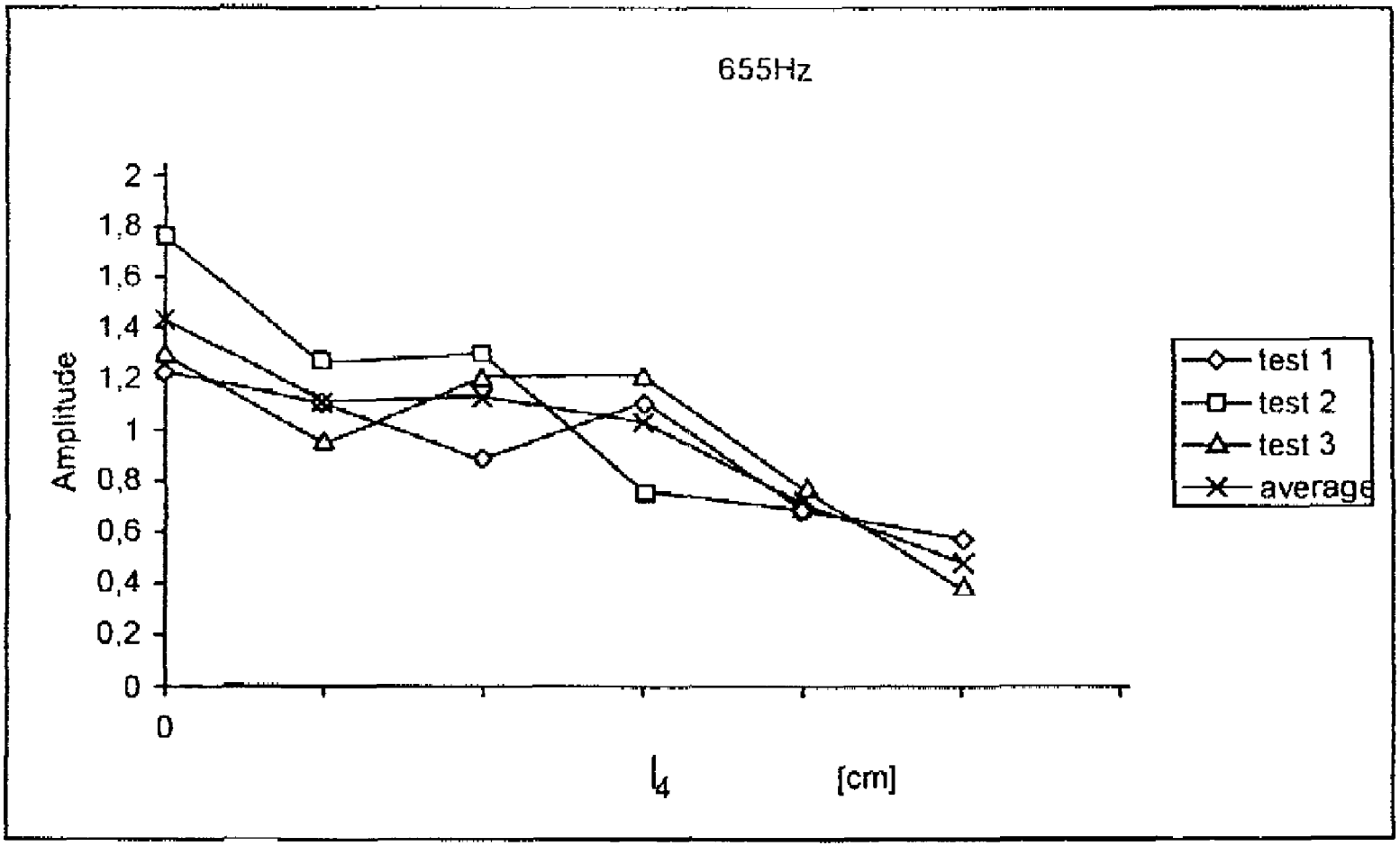
FIG. 3*a* shows the amplitude of the frame vibration at 655 Hz and FIG. 3*b* shows the amplitude of the stringing vibration at 725 Hz.
Figure 3B:
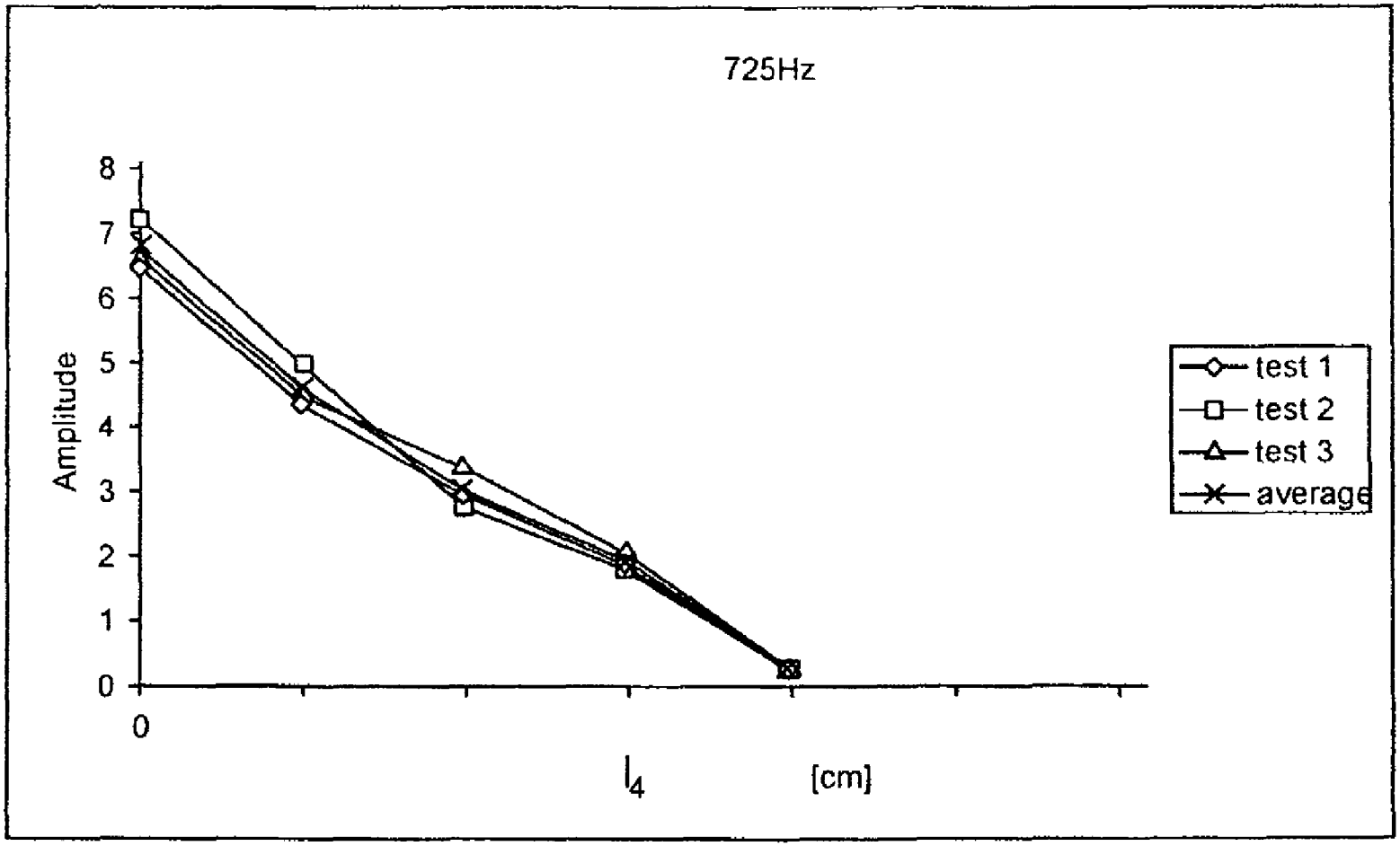

FIG. 3 shows curves of the vibration amplitude of the racket frame and the stringing depending on the distance of the center of gravity of a dampening element from the frame in the heart region of a racket ($l_4$), wherein FIG. 3*a* shows the amplitude of the frame vibration at 655 Hz and FIG. 3*b* shows the amplitude of the vibration of the stringing at 725 Hz depending on the distance, wherein three test series 1 to 3 and their average are shown as curves, wherein the vibration excitation takes place in the geometrical center of the stringing.

It is clearly evident that the exemplarily shown vibrations are clearly reduced by purposefully positioning the dampening element of the invention. In particular the vibration of the frame in the range of approximately 650 Hz, which is a vibration that is clearly audible and often sensed as being disturbing, can be dampened successfully.

The dampening behavior is particularly dependent on the above-mentioned values such as, e.g., mass of the head part 3, length $l_4$ and/or length $l_2$. For example, the dampening (reduction in the amplitude by x % relative to an non-dampened vibration) is approximately 0% with $l_4$=0.5 cm, approximately 33% with $l_4$=1 cm, approximately 45% with $l_4$=1.5 cm and approximately 1% with $l_4$=2 cm.

Figure 4:
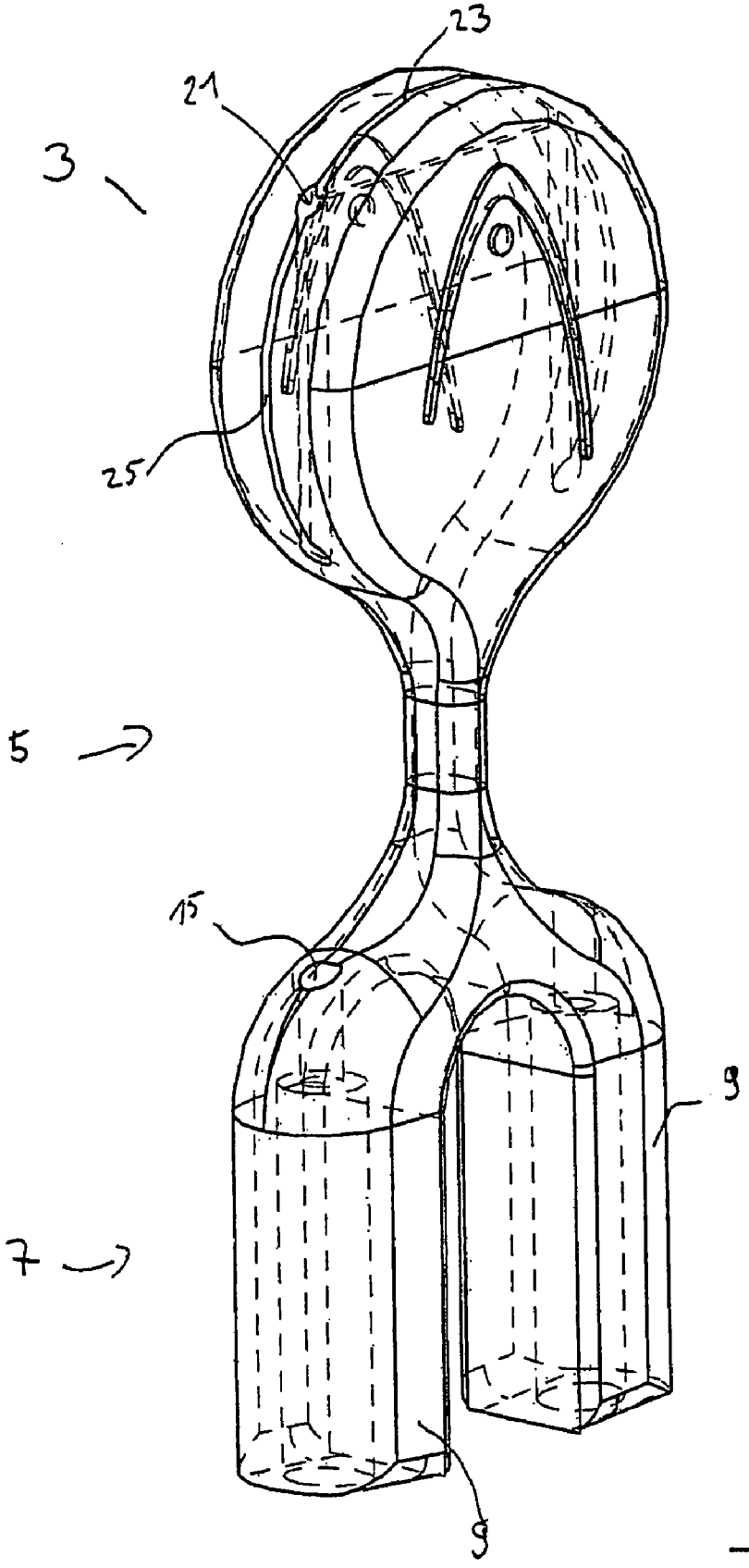
FIG. 4 is a spatial view of a dampening device according to the invention.

FIG. 4 shows a spatial view of a dampening device of the present invention, wherein hidden lines are dashed. The dampening device of FIG. 4 essentially corresponds to the dampening device described with reference to FIGS. 1 and 2.

Figure 5A:
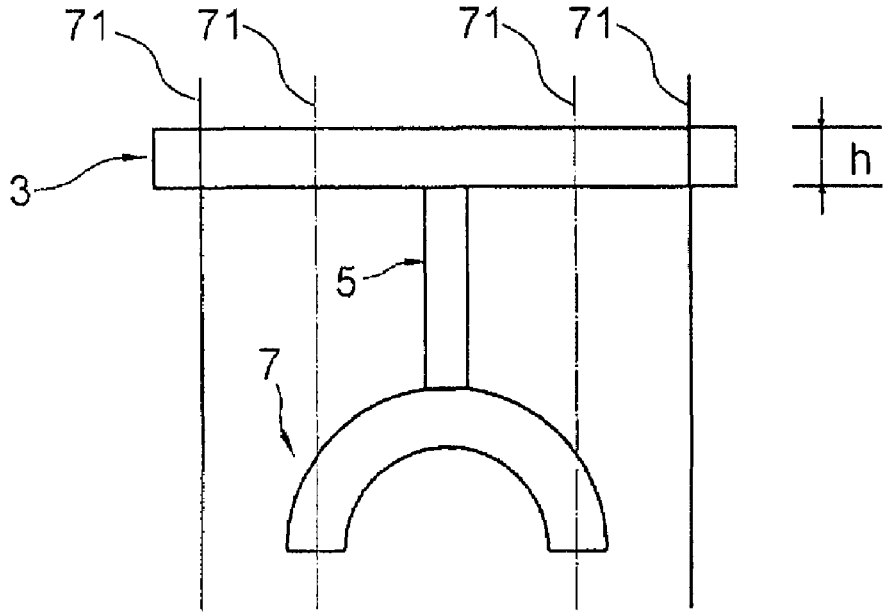
FIGS. 5*a* and 5*b* are schematic sketches of alternative dampening devices according to the invention.
Figure 5B:
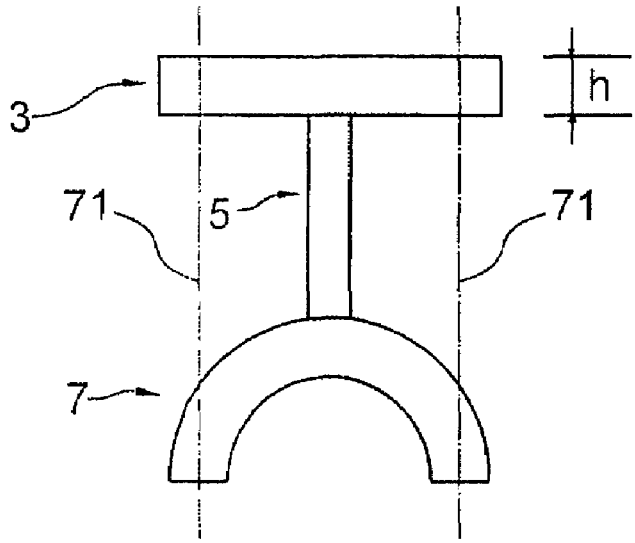

FIG. 5 shows schematic sketches of preferred alternative dampening devices of the invention which differ from the above-described ones in particular in view of the head shape. According to the representation in FIG. 5*a*, the head region 3 is formed essentially as an elongate cuboid in the direction of the transverse strings, which comprises retaining devices or openings for retaining four to eight longitudinal strings 71, preferably four longitudinal strings 71. According to the representation in FIG. 5*b*, the head region is formed essentially as an elongate cuboid in accordance with the representation of FIG. 5*a* and comprises retaining devices or openings for retaining two longitudinal strings. The head region of the dampening devices of FIG. 5*a* and FIG. 5*b* has preferably a height h of approximately 2 to 20 mm.

The dampening device of the present invention and the racket of the present invention allow an improved vibration behavior of the ball game racket, in particular in view of the vibrations transmitted to the player and the acoustic effects of the vibrations. Furthermore, the dampening device of the present invention has a low weight and thus does not have any negative effects on the racket or the handling of the racket. It leads to an improved playability behavior, in particular because the dampening device of the invention does not only allow a coupling of the strings and a harmonization of the string vibrations but can also cause a connection with the frame due to the connection between the dampening element and the fixing element. Thus, the string vibrations are dampened and also the frame vibrations are reduced. In particular, the dampening device of the present invention leads to an optimum sound improvement, preferably by filtering out the frame vibrations at approximately 655 Hz and/or a string vibration at approximately 725 Hz. Particularly advantageous is the connection of the head region 3 of the dampening element, which acts as a mass, with the foot or fixing region 7 through the web-shaped neck region 5 having a reduced cross-section. By shaping the neck region 3 in a suitable manner, in particular in view of the cross-section and/or length, an optimum positioning and an optimized behavior of the head region can be caused and thus an improved racket behavior can be achieved. The dampening device of the present invention can be produced and fixed in a cost-efficient manner.

Depending on the concrete realization of the features of the dampening device, the dampening behavior of the dampening device and the vibration behavior of the strings and/or the frame can be influenced. In a preferred embodiment, in particular the shape of the neck region 5, the head region 3 and/or the further geometrical dimensions of the dampening element lead to an optimization in the dampening behavior of the dampening device.

By adapting the configuration and/or the arrangement of the dampening element of the invention and in particular the described neck region 5, the specific properties and characteristics of the ball game racket can be adjusted in accordance with the requirements.

The invention claimed is:

1. A dampening device for a ball game racket comprising:
a foot region;
a head region; and
a tapering neck region arranged between the foot region and the head region,
wherein both the foot region and the head region are configured to be coupled to two or more strings.

2. The dampening device according to claim 1, wherein the neck region is configured as a bar.

3. The dampening device according to claim 1, wherein a cross-section of the neck region is reduced in at least one plane relative to that of the foot region and/or the head region.

4. The dampening device according to claim 1, wherein a cross-section of the neck region is reduced relative to that of the foot region and/or the head region.

5. The dampening device according to claim 1, wherein the foot region is essentially U-shaped, and wherein a base leg of the U-shape is connected with the neck region.

6. The dampening device according to claim 1, wherein the foot region comprises at least two legs extending essentially parallel with each other for retaining one longitudinal string of a racket stringing each.

7. The dampening device according to claim 1, wherein the foot region comprises at least one opening for retaining a longitudinal string.

8. The dampening device according to claim 7, wherein the opening is realized as a bore having a variable diameter.

9. The dampening device according to claim 7, wherein the opening is configured such that it firmly encloses the longitudinal string at least partially.

10. The dampening device according to claim 1, wherein the neck region provides a defined distance between the foot region and the head region and/or between the head region and a frame at a racket heart.

11. The dampening device according to claim 1, wherein the head region comprises means for retaining at least two strings.

12. The dampening device according to claim 11, wherein the means are configured as cavities, slots, grooves and/or bores.

13. The dampening device according to claim 11, wherein the means for retaining is flush with corresponding openings in the foot region.

14. The dampening device according to claim 1, wherein the head region is configured for being coupled with at least two longitudinal strings and at least one transverse string.

15. The dampening device according to claim 1, wherein the head region represents essentially a dampening mass or is connected with a dampening mass.

16. The dampening device according to claim 15, wherein the dampening mass is approximately 0.5 g to 15 g.

17. The dampening device according to claim 1 in combination with a fixing element for being fixed to a racket frame.

18. A ball game racket comprising:
a dampening device according to claim 1, wherein the dampening device is arranged in a stringing region of the ball game racket.

19. A dampening device for a ball game racket comprising:
a foot region;
a head region configured for being coupled with at least two longitudinal strings and at least one transverse string; and
a tapering neck region arranged between the foot region and the head region.

20. A dampening device for a ball game racket comprising:
a foot region;
a head region comprising means for retaining at least two strings, wherein the means for retaining is flush with corresponding openings in the foot region; and
a tapering neck region arranged between the foot region and the head region.

* * * * *